US006253053B1

(12) United States Patent
Litman et al.

(10) Patent No.: US 6,253,053 B1
(45) Date of Patent: Jun. 26, 2001

(54) ENHANCED PHENOLIC DEVELOPER ROLL SLEEVES

(75) Inventors: Alan M. Litman, Webster; Michael F. Zona, Holley; Rafael Malespin, Rochester, all of NY (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/480,850

(22) Filed: Jan. 11, 2000

(51) Int. Cl.[7] ..... G03G 15/08

(52) U.S. Cl. ..... 399/286; 399/265; 492/56

(58) Field of Search ..... 399/286, 279, 399/265, 266, 267, 252; 118/653, 657, 658; 428/332, 335; 430/101, 120; 492/8, 16, 48, 49, 56

(56) References Cited

U.S. PATENT DOCUMENTS

| | | |
|---|---|---|
| Re. 32,883 | 3/1989 | Lu . |
| Re. 35,698 | 12/1997 | Behe et al. . |
| 3,841,265 | 10/1974 | Howarth et al. . |
| 3,929,098 | 12/1975 | Liebman . |
| 3,993,023 | 11/1976 | Stansell . |
| 4,034,709 | 7/1977 | Fraser et al. . |
| 4,118,115 | 10/1978 | Hewitt . |
| 4,278,733 | 7/1981 | Benzinger . |
| 4,338,222 | 7/1982 | Limburg et al. . |
| 4,338,390 | 7/1982 | Lu . |
| 4,505,573 | 3/1985 | Brewington et al. . |
| 4,540,645 | 9/1985 | Honda et al. . |
| 4,565,437 | 1/1986 | Lubinsky . |
| 4,566,907 | 1/1986 | Kagota . |
| 4,809,034 | 2/1989 | Murasaki et al. . |
| 4,868,600 | 9/1989 | Hays et al. . |
| 4,990,963 | 2/1991 | Yamamoto et al. . |
| 5,012,072 | 4/1991 | Martin et al. . |
| 5,079,129 | 1/1992 | Roth et al. . |
| 5,144,371 | 9/1992 | Hays . |
| 5,177,538 | 1/1993 | Mammino et al. . |
| 5,194,358 | 3/1993 | Bayley et al. . |
| 5,245,392 | 9/1993 | Behe et al. . |
| 5,253,019 | 10/1993 | Brewington et al. . |
| 5,300,339 | 4/1994 | Hays et al. . |
| 5,386,277 | 1/1995 | Hays et al. . |
| 5,506,745 | 4/1996 | Litman . |
| 5,517,538 | 5/1996 | Seidelberger et al. . |
| 5,555,184 | 9/1996 | Jaskowiak et al. . |
| 5,585,901 * | 12/1996 | Watanabe et al. ..... 399/267 |
| 5,655,196 | 8/1997 | Litman et al. . |
| 5,714,248 | 2/1998 | Lewis . |
| 5,731,078 | 3/1998 | Hsieh et al. . |
| 5,758,242 | 5/1998 | Malespin et al. . |

* cited by examiner

*Primary Examiner*—Arthur T. Grimley
*Assistant Examiner*—Hoan Tran
(74) *Attorney, Agent, or Firm*—Oliff & Berridge, PLC

(57) ABSTRACT

A developer roll sleeve and method for making the same is disclosed. In a preferred embodiment, a core substrate roll is spray coated with a conductive composition including a host resin composition and a wear-resistance imparting additive. Preferably, the host resin composition includes a phenolic thermosetting resin and a conductivity additive such as carbon black, graphite and the like. Further, the wear resistance imparting additive is preferably selected from the group consisting of a polytetrafluoroethylene resin (e.g., Teflon), graphite, ultra-high molecular weight polyethylene having a molecular weight from about 3,000 to about 4,500 grams, molybdenum, molybdenum disulfide, silicone and mixtures thereof. The wear resistance imparting additive is preferably provided in an amount sufficient to obtain a thickness wear rate of less than about 0.00047 percent per printing cycle.

11 Claims, 8 Drawing Sheets

ENHANCED PHENOLIC DEVELOPER ROLL SLEEVES

FIELD OF THE INVENTION

The present invention relates to a developer roll and a developer roll sleeve. More particularly, the present invention relates to a method for making the roll or sleeve coated with a wear-resistant conductive composition containing additives that improve, for example, the coating life, tribo/toner charging, toner release, or charge blade life.

BACKGROUND OF THE INVENTION

The basic operation of an electrostatographic printing machine is well known to those of ordinary skill. The term "electrostatographic" encompasses both electrophotographic and electrostatic printing. Typically, electrophotographic and electrostatic printing methods utilize a developer roll and a developer roll sleeve in the manner described below, except that electrostatic printing uses an insulating medium while electrophotographic printing uses a photosensitive medium to record an electrostatic latent charge image pattern on the medium.

Inasmuch as the art of electrophotographic printing is well known, reference is made to FIG. 1 which schematically depicts various parts of an exemplary electrophotographic printing machine. As depicted in FIG. 1, a drum 10 having a photoconductive surface 12 is positioned to rotate in direction 14 about a central axis 15. Around the periphery of drum 10 are provided a first corona generating device 16, an exposure station 18, a developer station 20, a substrate stack 22 to supply single sheets of substrate 22*a* (via registration rolls 30, 31, and 32 rotating in the direction indicated by arrows 34 to advance single sheets of substrate 22*a* through chute 31*a*), a second corona generating device 36, an endless belt 38, a fixing station 60, and a cleaning mechanism 40. These components are used in concert to produce a duplicate image of an original image (not shown) onto a substrate surface such as paper. The various steps involved in a "printing cycle" are described in greater detail below.

During a typical electrophotographic printing cycle, the drum 10 is routinely rotated (typically at uniform speed) in direction 14 to interact with the various components of an electrophotographic printing machine. A typical printing cycle begins with the exposure of the photoconductive surface 12 to a uniform electrostatic charge at the first corona generating station 16 as drum 10 is rotated in direction 14 thereunder. Thus, under the influence of the first corona generating device 16, the photoconductive surface 12 becomes uniformly charged. As it is subsequently rotated under exposure station 18, the uniformly charged photoconductive surface 12 is exposed to a photographic light image (of an original image to be duplicated). During such exposure, photoconductive surface 12 on drum 10 is rotated about axis 15 (typically at a uniform rate). Thereby, a duplicate image of the original image intended to be copied is recorded on the photoconductive surface 12 in the form of an electrostatic latent charge image pattern.

At exposure station 18, exposing light causes the uniform charge on surface 12 of drum 10 to be dissipated to yield the electrostatic latent charge image pattern as noted below. The amount of the uniform charge dissipated is proportional to the intensity of the exposing light. Those portions of photoconductive surface 12 not exposed to light at exposure station 18 continue to maintain a uniform charge. Thus, exposed portions of photoconductive surface 12 exhibit a dissipation of the uniform electrostatic charge while non-exposed portions maintain a uniform electrostatic charge. Thereby, photoconductive surface 12 now retains an electrostatic latent charge image pattern which corresponds to the photographic image of the original document. As photoconductive surface 12 on drum 10 is rotated beyond exposure station 18, the electrostatic latent charge image pattern recorded thereon is now ready for "development" at developer station 20.

Development of the electrostatic latent charge image recorded on the photoconductive surface 12 is achieved by transferring toner to the photoconductive surface 12. For proper development, the toner is transferred to the photoconductive surface 12 in a manner that duplicates the pattern of the electrostatic latent charge image. Effective development is accomplished by transferring toner particles to the electrostatic latent charge image at a controlled rate so that the toner particles adhere electrostatically to the charged areas of the recorded electrostatic latent image. Typically, the degree of transfer of the toner to photoconductive surface 12 at developer station 20 is proportional to the charge carried by the electrostatic latent image.

Commonly, either a one-component (a single component toner) or a two-component toner (carrier and toner) may be used for development of the electrostatic latent charge image. A typical two-component toner comprises toner particles tribo-electrically attached to magnetic carrier granules or beads. A typical one-component toner is a single component particle which has both magnetic and electrostatic properties. When the one-component or the two-component toner is placed in a magnetic field, the toner particles form what is known as a "magnetic brush." In particular, the toner particles within the magnetic field form relatively long chains which resemble the fibers of a brush. Thus, the term "magnetic brush" is aptly descriptive.

The developer roll 8 is optionally provided with a cylindrical sleeve 8*a*. Typically, the developer roll 8 is provided with an assembly of permanent magnets (not shown). Under the influence of a magnetic field (e.g., produced by the assembly of permanent magnets within the developer roll), the toner particles form the "magnetic brush" on the outer periphery of the developer roll 8 or on the outer periphery of the optimal developer roll sleeve 8*a*.

At the developer station 20, when the electrostatic latent charge image is advanced adjacent to the magnetic brush at nip 100*b*, the electrostatic charge on the photoconductive surface 12 is so biased that it attracts the toner particles away from the magnetic brush disposed on developer roll sleeve 8*a* (or on developer roll 8).

While a "magnetic brush" development scheme has been described, other development schemes such as "scavengeless" development, single component development, single component scavengeless development and the like may be used. Each of these development schemes use a developer roll sleeve, a developer roll or an equivalent thereof.

By the transfer of toner particles, the photoconductive surface 12 now carries on its surface toner particles in a pattern that corresponds to the electrostatic latent charge image, which in turn corresponds to the photographic image of the original document intended to be duplicated. Hereinafter, the photoconductive surface 12 having toner particles deposited thereon in the aforementioned manner is referred to as the "developed" toner image.

As the drum 10 (together with the developed toner image) is advanced beyond developer station 20, registration rolls 30, 31, and 32 are rotated in the direction of arrows 34 to advance single sheets of substrate 22*a* (e.g., paper) through chute 31*a*. In general, chute 31*a* directs the advancing sheet of substrate 22*a* into contact with drum 10 in a timed relationship so that the developed toner image contacts the advancing sheet of substrate 22*a* at nip location 100, situated between the second corona generating device 36 and drum 10. Preferably, the exemplary single sheet of substrate 22*a* is advanced to simultaneously arrive at nip 100 at about the same time as does the leading edge of the developed toner image disposed on surface 12 of drum 10. At least substantially simultaneously, the second corona generating device 36 is powered-up to apply a spray of ions onto the backside of substrate sheet 22*a* disposed adjacent to the developed toner image at nip location 100. Thereby, the single substrate sheet 22*a* is so charged as to cause transfer of the developed toner image (i.e., toner particles adhering to the photoconductive surface 12) directly onto the substrate sheet 22*a*. By such transfer, the toner is deposited onto substrate sheet 22*a* in a pattern which corresponds to the image of the original document intended to be duplicated.

Substrate sheet 22*a* is then advanced by endless belt 38 through fuser rolls/pressure rolls 69 and 70 to heat and permanently affix the transferred toner pattern onto substrate sheet 22*a*. Accordingly, the pattern corresponding to the original document intended to be copied is permanently affixed onto substrate sheet 22*a*. Appropriate rotation of fuser rolls/pressure rolls 69 and 70 advances the substrate sheet 22*a* onto collection tray 64.

Invariably, after transfer of the toner (from the developed toner image on photoconductive surface 12) onto substrate sheet 22*a*, some residual toner remains attached to photoconductive surface 12. To remove any residual toner, the photoconductive surface 12 is now advanced to cleaning mechanism 40. After cleaning, a discharge lamp (not shown) is used to flood the entire photoconductive surface 12 with light to dissipate any residual electrostatic latent charge that may be present thereon. In this manner, the photoconductive surface 12 is returned to its initial electrostatic charge level present immediately prior to uniform recharging thereof by the first corona generating device 16. The foregoing procedure outlines a typical "printing cycle" of an electrophotographic printing machine.

Repetition of the above-noted "printing cycle" procedure permits use of drum 10 in conjunction with developer roll 8 and/or developer roll sleeve 8*a* for another duplication cycle. The photoconductive surface 12, the developer roll 8, and the developer roll sleeve 8*a* are repeatedly used in the fashion indicated above. Such repeated use ultimately causes undesirable degradation of surface 9. Problems on surface 9 associated with degradation include, but are not limited to, undesirable streaking and ghosting. To reduce the wear and tear on the developer roll 8 and/or the developer roll sleeve 8*a* caused by their repeated use, it is desirable to provide a wear-resistant surface 9 on developer roll 8 (if no developer roll sleeve is provided) or, if provided, on developer roll sleeve 8*a*.

It is likewise desirable to provide a wear-resistant conductive composition to form a coating (having a wear-resistant surface 9) applied either directly onto a developer roll 8 or onto a developer roll sleeve 8*a*. The wear-resistant conductive composition affixed onto developer roll 8 or onto developer roll sleeve 8*a* is desirable to improve coating life, to enhance tribo/toner charging, to improve toner release, to prolong charge blade life, to reduce streaking, to reduce ghosting or other undesirable problems associated with repeated use.

Thus, it is desirable to provide a developer roll coated with an improved wear-resistant coating, a method for making the same, a developer roll sleeve coated with the improved coating, and a method for making the same for alleviating one or more of the aforementioned problems.

The following patents may be relevant to various aspects of the present invention: U.S. Pat. Nos. 5,253,019 (Brewington et al.), 5,177,538 (Mammino et al.), 4,505,573 (Brewington et al.), 4,809,034 (Murasaki et al.), 5,300,339 (Hayes et al.), and 5,386,277 (Hays et al.). Each of these patents is incorporated herein by reference in its entirety.

SUMMARY

It is therefore an object of the present invention to provide a wear-resistant coating on a developer roll or on a developer roll sleeve for use in conjunction with, for example, the above-noted electrophotographic printing or electrostatic printing process for the advantages associated therewith such as to eliminate ghosting, streaking or other such problems (associated with repeated use of conventional developer rolls, sleeves and coating materials).

According to one embodiment, these and other objects are accomplished by a core substrate roll coated with a conductive composition comprising a host resin composition containing one or more wear-resistance imparting additives in an amount sufficient to improve the wear-resistant properties thereof. According to other embodiments, the conductive composition is provided directly on a developer roll or on a developer roll sleeve affixed to a developer roll. According to yet another embodiment, the core substrate roll is coated with the aforementioned conductive composition by a coating process which involves a coating step that is other than an extrusion coating process. Such effective coating processes include e.g., spray coating, dip coating, etc.

DETAILED DESCRIPTION OF CERTAIN PREFERRED EMBODIMENTS

Figure 1:
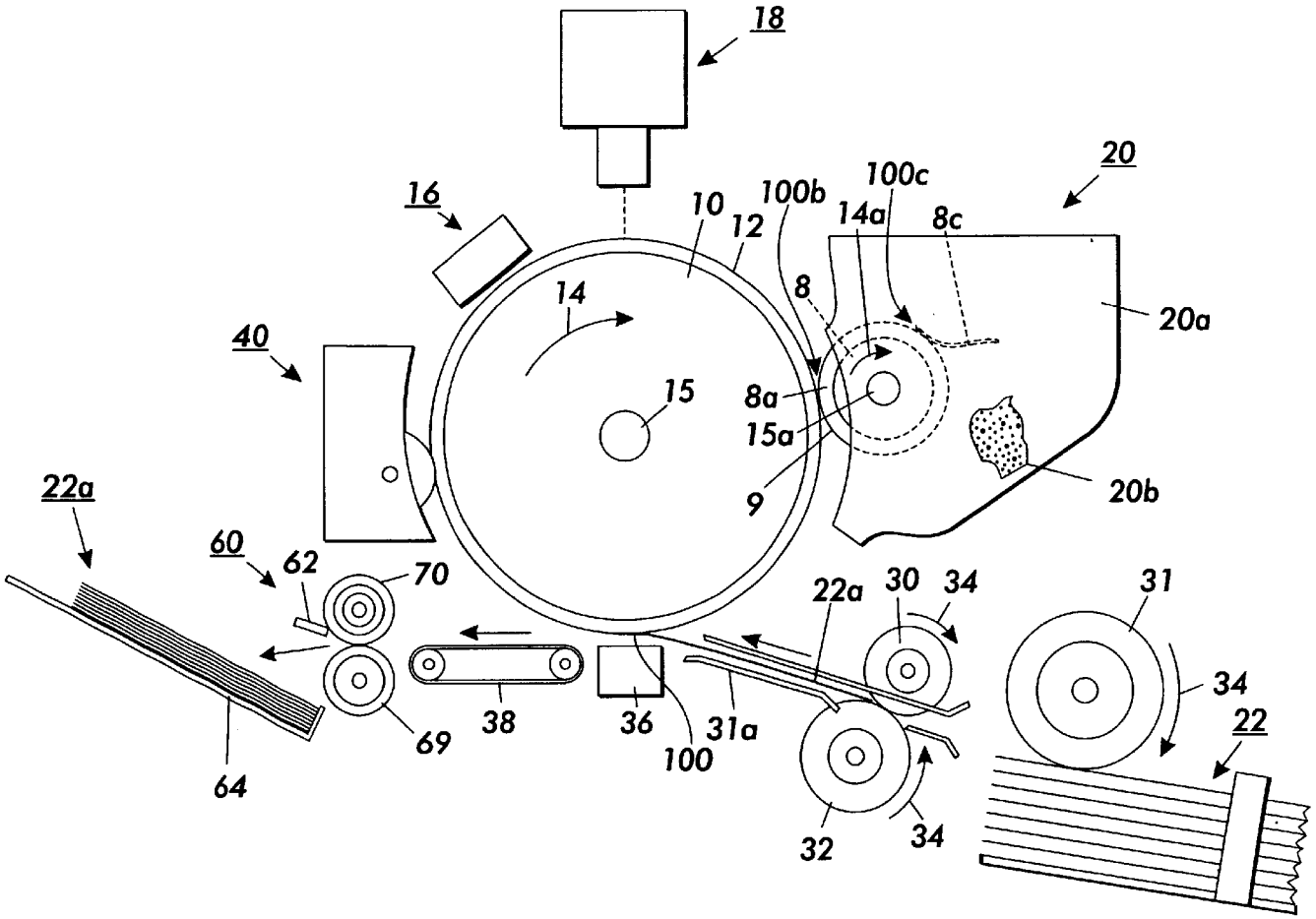
FIG. 1 is a schematic cross-sectional view of an exemplary electrophotographic printing machine.

Although the developer roll sleeve and the process for making the same described in conjunction with the present invention is particularly well suited for use with the electrophotographic printing machine of FIG. 1, it is to be understood by those of ordinary skill in the printing and duplicating arts that the developer roll sleeve (and method for making the same) is particularly well adapted for use in a wide variety of electrostatographic printing machines and is not necessarily limited in its application to the particular embodiments shown and described herein.

Figure 2:
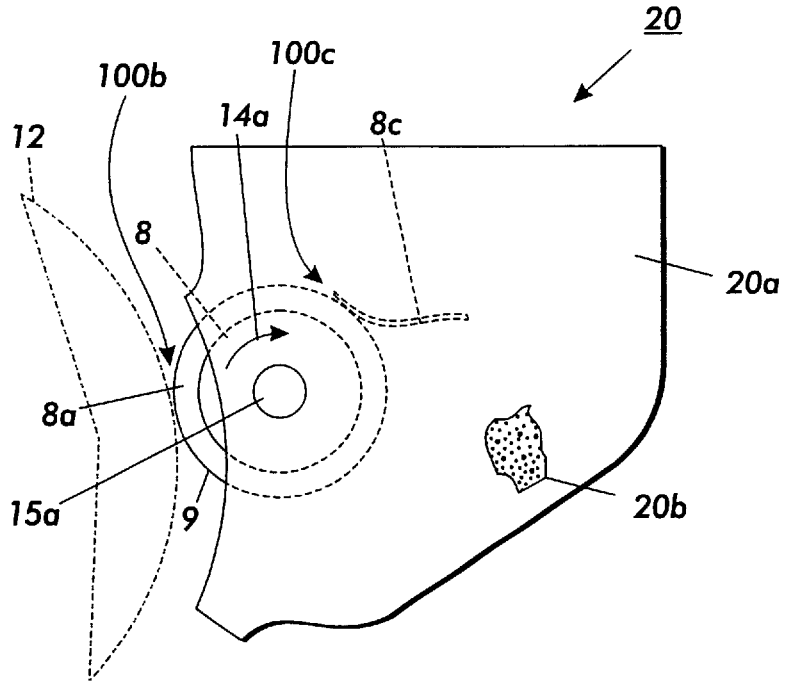
FIG. 2 is a schematic cross-sectional view of the exemplary developer station 20 unit depicted in FIG. 1.
Figure 3:
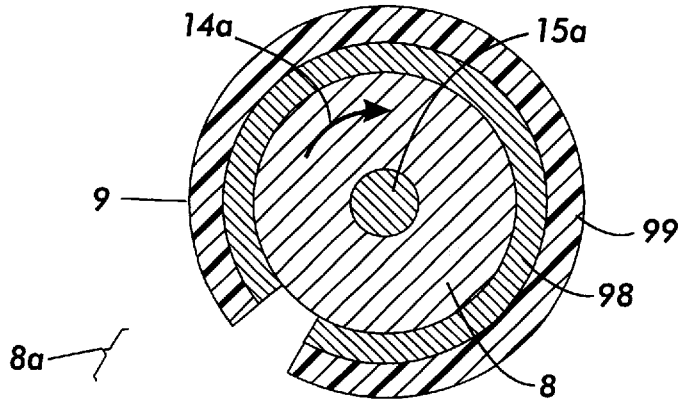
FIG. 3 is a schematic cross-sectional view of an exemplary developer roll sleeve 8*a* disposed around the developer roll 8 of FIG. 2.

While the embodiments of FIGS. 1–3 are depicted with a developer roll sleeve 8*a* having a surface 9 affixed to developer roll 8, the developer roll sleeve itself is optional. If the developer roll sleeve 8*a* is omitted, then the conductive composition may be applied directly to developer roll 8. Thereby, the conductive composition forms a surface 9 directly on developer roll 8 instead of on the developer roll sleeve 8*a*.

Referring to FIGS. 1–3, developer station 20 has a housing 20*a* with a supply of toner 20*b* provided therein to render the electrostatic latent charge image on photoconductive surface 12 visible. In addition, within housing 20*a* are provided developer roll 8, a developer roll sleeve 8*a* having a surface 9 and a charging (i.e., charge/metering) blade 8*c*. The developer roll 8, the developer roll sleeve 8*a*, the surface 9 are affixed to one another in the manner depicted in FIGS. 1–3. Accordingly, when developer roll 8 is rotated in direction 14*a*, the developer roll 8 (optionally together with any permanent magnets provided therein (not shown)), the developer roll sleeve 8*a* and surface 9 are rotated in direction 14*a*. Optionally, however, it is possible to rotate developer roll sleeve 8*a* and surface 9 in direction 14*a* with the use of a gear mechanism around a stationary developer roll 8. Each such embodiment is provided with permanent magnets (not shown), as is well recognized by those of ordinary skill.

Referring to FIG. 3, developer roll sleeve 8*a* is depicted as being affixed to developer roll 8. The cut-away of developer roll sleeve 8*a* in FIG. 3 reveals a core substrate material 98, and a conductive composition 99, the surface of which conductive composition is surface 9. The core substrate roll 98 is typically a non-ferromagnetic material including, but not limited to, aluminum, plastic, non-ferromagnetic stainless steel, other non-ferromagnetic materials, combinations and mixtures thereof and the like. The thickness of the core substrate roll 98 may be varied. However, it should be sufficiently thick as to provide ample support for a conductive composition 99 deposited thereon and intended to be used in a electrophotographic or other printing machine. Preferably, the core substrate roll 98 has a thickness from about 1 mm to about 2 mm.

Prior to applying the coating of the conductive composition 99 onto the core substrate roll 98, it is preferred to roughen the surface of the core substrate roll 98 to a roughness sufficient to permanently affix the conductive composition 99 thereon for use in a developer station (e.g., developer station 20) of an exemplary electrophotographic printing machine. Preferably, the surface of the core substrate roll 98 is roughened to a surface roughness from about 1 Ra to about 3 Ra. Surface roughening methods for use in conjunction with the claimed invention include, but are not limited to, grinding, sanding, sandblasting, steel wooling, etching with an acid or base, combinations thereof and the like. The selected surface roughening method should be sufficient to provide the desired surface finish, diameter, straightness, runout, and other mechanical tolerance requirements. After surface roughening, the core substrate roll 98 is cleaned. Thereafter, a coating of the conductive composition 99 is applied to the cleaned surfaces.

The conductive composition 99 is coated on the core substrate roll 98 in an amount sufficient to provide a thickness wear rate of less than about $4.7\times104^{-4}$ percent per printing cycle based on an initial thickness of the conductive composition of not more than 300 microns. The conductive composition 99 comprises a host resin composition and a wear-resistance imparting additive. The host resin composition comprises a conductivity additive and a resin. The conductive composition should be one selected to have a conductivity sufficient to attract toner particles to its surface and sufficient to transfer toner particles to an electrostatic latent charge image pattern to form a developed toner image. The conductive composition should be chosen to best suit the development method selected including, but not limited to, magnetic brush development, scavengeless development, single-component scavengeless development, jumping development, powder cloud development, touchdown development, cascade development, combinations thereof and the like.

The conductivity additive is preferably selected and added to the host resin composition sufficient for the conductive composition to have a conductivity from about 1 ohm-cm to about $10^9$ ohms-cm. Typically, the conductivity additive is added to the host resin composition in an amount from about 1% by weight to about 10% by weight based on a total weight of the conductive composition (containing at least the host resin composition and the wear-resistance imparting additive). Suitable conductivity additives for use in conjunction with the claimed invention include, but are not limited to, graphite, carbon black and mixtures thereof.

Typically, the resin of the host resin composition is a thermosetting resin, preferably a non-hygroscopic resin. The preferred resin is a thermosetting phenolic resin. The resin may be hardened by methods well known to those of ordinary skill including, but not limited to, use of a hardener, heat, visible light, UV light, combinations thereof and the like.

To form the conductive composition, a wear resistance imparting additive is added to the host resin composition. The wear-resistance imparting additive should be one that is sufficient to improve, for example, the wear-resistance of the conductive composition, the coating life of the conductive composition, the tribo/toner charging by the charging blade 8*c*, the toner release at nip location 100*b* to form the developed toner image, print quality, performance and life of surface 9, and the charging blade life. Preferably, the amount of the wear resistance additive added to the conductive composition is sufficient to achieve a thickness wear rate of less than about $4.7\times10^{-4}$ percent per printing cycle based on an initial thickness of the conductive composition of not more than 300 microns. The thickness wear rate refers to the change in thickness of the conductive composition coating after one printing cycle divided by the initial thickness, the product thereof times 100 (i.e., $(\Delta T/T_o)\times100$=thickness wear rate; $\Delta T$=change in conductive composition coating thickness after one printing cycle and $T_o$=the initial thickness of the conductive composition coating just before first use in a printing cycle).

Even though the thickness wear rate measurement is based on an initial thickness of not more than 300 microns, it is to be understood that the thickness of the thermosetted conductive composition may itself be greater than 300 microns. The term "printing cycle" has previously been described herein. The wear-resistance imparting additive added to the host resin composition is preferably from about 0.5% by weight to about 20% by weight based on a total weight of the conductive composition.

The wear-resistance imparting additive is selected from the group consisting of a polytetrafluoroethylene resin, graphite, polyethylene having a molecular weight from about 3,000 grams to about 4,500 grams, molybdenum, molybdenum disulfide, silicone and mixtures thereof Additionally, according to a preferred embodiment, the conductivity additive and the wear-resistance imparting additive are not the same material.

Preferably, the conductive composition 99 is coated onto the core substrate roll 98 by a method other than extrusion. Preferably, the conductive composition 99 is spray coated, electrostatic coated, electroplate coated, roll coated, dip coated, or coated by a combination thereof onto the core substrate roll 98. Further, the coating method may be selected from the group consisting of: (1) spray coating, electrostatic coating, electroplate coating, roll coating, dip coating and combinations thereof; (2) spray coating, electrostatic coating, electroplate coating, dip coating and combinations thereof; (3) spray coating, dip coating, roll coating and combinations thereof; (4) spray coating, roll coating, dip coating, and combinations thereof; (5) spray coating, electrostatic coating, and combinations thereof; (6) spray coating, roll coating, and combinations thereof; (7) spray coating, dip coating, and combinations thereof; and (8) spray coating, electroplate coating, and combinations thereof. More preferably, the conductive composition 99 is spray coated.

Spray coating provides surprising and unexpected cost and performance benefits over conventional extrusion coating methods. For example, the surface smoothness of surface 9 is enhanced by the spray coating method over an extrusion method. Further, with spray coating, pinholes, other voids or surface defects are minimized or altogether as compared to those achievable with extrusion coating methods. Additionally, the spray coating method is simpler than an extrusion coating method.

A preferred spray coating process involves the detailed procedure described below. In particular, dilute solutions of phenolic resins such as Acheson's Emralon® GP 1904 (containing graphite), Emralon® 305, Emralon® 330 or the like are made by adding methyl ethyl ketone (MEK) or similar solvent to the resin. Product specification sheets for Emralon® GP 1904, Emralon® 305 and Emralon® 330, are incorporated herein by reference in their entirety. Typically, the dilute solution comprises three parts by weight resin (e.g., phenolic resin) and one part by weight solvent (e.g., MEK). An atomizing gun is used to spray coat the dilute solution on a developer roll or a core substrate roll at about 30–50 psi pressure.

Electrostatic coating involves electrostatically applying the conductive composition onto the developer roll or onto the core substrate roll. Roll coating involves rolling the developer roll or the core substrate roll in the conductive composition. Dip coating involves dipping the developer roll 8 or the core substrate roll 98 into the conductive composition.

Preferably, the aforementioned coating methods should be utilized to provide a conductive composition coating of uniform thickness and essentially free of surface defects including, but not limited to, pin holes, voids, streaks, creases, uneven surface formations, uneven smoothness, excessive roughness and the like. After application of the conductive composition coating, the conductive composition coating is cured (i.e., thermosetted) by an appropriate method such as heating. Preferably, thermosetting is accomplished by applying heat at a thermosetting temperature from about 150° C. to about 204° C. for a thermosetting time from about 8 minutes to about 60 minutes. After thermosetting the conductive composition, the thickness of the conductive composition should be sufficient to be successfully used in a developer station. Preferably, the thermosetted conductive composition coating has an initial thickness from about 12 microns to about 300 microns, more preferably about 20 microns.

The process for making an exemplary developer roll sleeve 8*a* in accordance with an embodiment of the present invention comprises the steps of:

(a) providing a core substrate roll having an outer circumferential surface;

(b) surface finishing said outer circumferential surface sufficient to provide a surface roughness of at least about 1 Ra;

(c) coating said outer circumferential surface with a conductive composition comprising a thermosetting resin, a conductivity additive and a wear-resistance imparting additive, wherein said conductive composition is provided in an amount sufficient to obtain a thickness wear rate of less than about $4.7\times10^{-4}$ percent per printing cycle based on an initial thickness of said conductive composition of not more than 300 microns, and wherein said conductive composition is coated onto said core substrate roll by a method other than extrusion; and (d) thermosetting the conductive composition coated on said core substrate roll.

The following examples are provided to further define the species of the present invention. These examples are intended to illustrate (and not limit the scope of) the present invention. Unless indicated otherwise, parts and percentages below are by weight based on a total weight of the conductive composition.

EXAMPLES

The OEM Magroll, OEM1 Magroll, OEM2 Magroll, OEM3 Magroll, Test 1 Magroll, Test 2 Magroll, Test 3 Magroll, and Test 4 Magroll are prepared according to the detailed procedures outlined below. The OEM Magroll, OEM1 Magroll, OEM2 Magroll, and OEM3 Magroll are conventional developer roll sleeves. The Test 1–4 Magrolls are embodiments of developer roll sleeves made in accordance with the present invention.

Example 1

The OEM Magroll, OEM1 Magroll, OEM2 Magroll, and OEM3 Magroll are developer roll sleeves made by Tokai Rubber Industries, Ltd. The OEM Magroll, OEM1 Magroll, OEM2 Magroll, and OEM3 Magroll have a core substrate roll made of aluminum having a surface finish of 1–3 Ra (measured by a surface profilometer-Surfcom 575–3D System made by Tokyo Seimitsu) and a thickness of 0.75 mm. These conventional OEM Magrolls were made according to the detailed procedure outlined below. In particular, a phenolic thermoset resin was extruded in a cylindrical form. The inside diameter of the extrusion was slightly larger than the outside diameter of the aluminum core substrate roll. The aluminum core substrate roll was placed inside the phenolic extrusion and held in place by a conductive glue or by interference fit. The developer roll optionally contained a multi-pole magnet placed inside the aluminum core substrate roll. The multi-pole magnet was held in place using aluminum end caps, one on each end of the aluminum core substrate roll. These OEM Magrolls were placed in the Xerox 4213 developer module, the specifications of which are incorporated herein by reference in their entirety.

Example 2

The Test 1–3 Magrolls are embodiments of a developer roll sleeve made in accordance with the present invention. The Test 1–3 Magroll was prepared by the detailed procedure described below. In particular, an aluminum core substrate roll was diamond turned on a lathe and grit blasted using glass beads and silica. The final surface roughness was between 1–3 Ra. This finish provided improved adhesion of the conductive composition, as well as, aided in achieving the desired post-coating finish of the developer roll sleeve so made. Acheson's Emralon® GP 1904 was used to coat the aluminum core substrate roll. Three parts of Emralon® GP 1904 were diluted with one part methyl ethyl ketone (MEK). The dilute mixture of Emralon® GP 1904 and MEK was sprayed onto the aluminum core substrate roll sleeve using an atomizer operated at 30≧50 psi. These Test Magroll sleeves were then baked at 350° F. (177° C.) for 10 minutes to cure/thermoset the conductive composition and flash off the MEK solvent. The final coating thickness was measured to be 25–30 microns. Each Test Magroll was then assembled with a magnet assembly and aluminum end caps to provide a finished developer roll assembly for testing in a Xerox 4123 developer module.

Example 3

Figure 4:
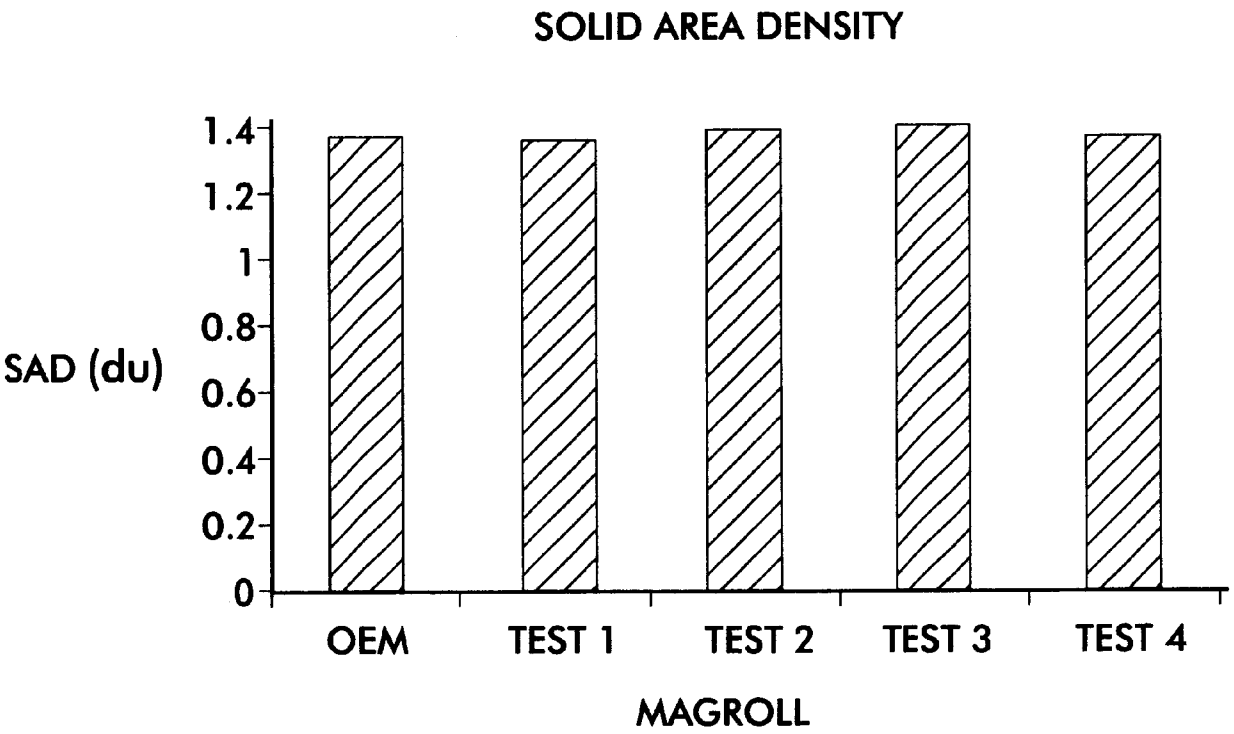
FIG. 4 is a bar graph depicting the comparative solid area density achieved by four embodiments of developer roll sleeves (Test 1 Magroll, Test 2 Magroll, Test 3 Magroll and Test 4 Magroll, each made in accordance with the present invention) and by a conventional developer roll sleeve (OEM Magroll). The bar graph compares the solid area density (SAD) in densitometer units.

A comparison of the solid area density achieved by the various above-noted Magrolls was made in accordance with the detailed procedure outlined below. In particular, the detailed comparison procedure followed was to generate solid area patches using OEM and Test Magrolls. Using a reflective densitometer (MacBeth RD-918 or MacBeth RD-1200) solid area density (SAD) measurements were made for solid area patches generated by the OEM and Test Magrolls. The bar graph of FIG. 4 provides the comparative SAD measurements in densitometer units. It can be seen from FIG. 4 that all the Test 1–4 Magrolls performed as well as or better than the OEM Magroll in the SAD comparison.

Example 4

Figure 5:
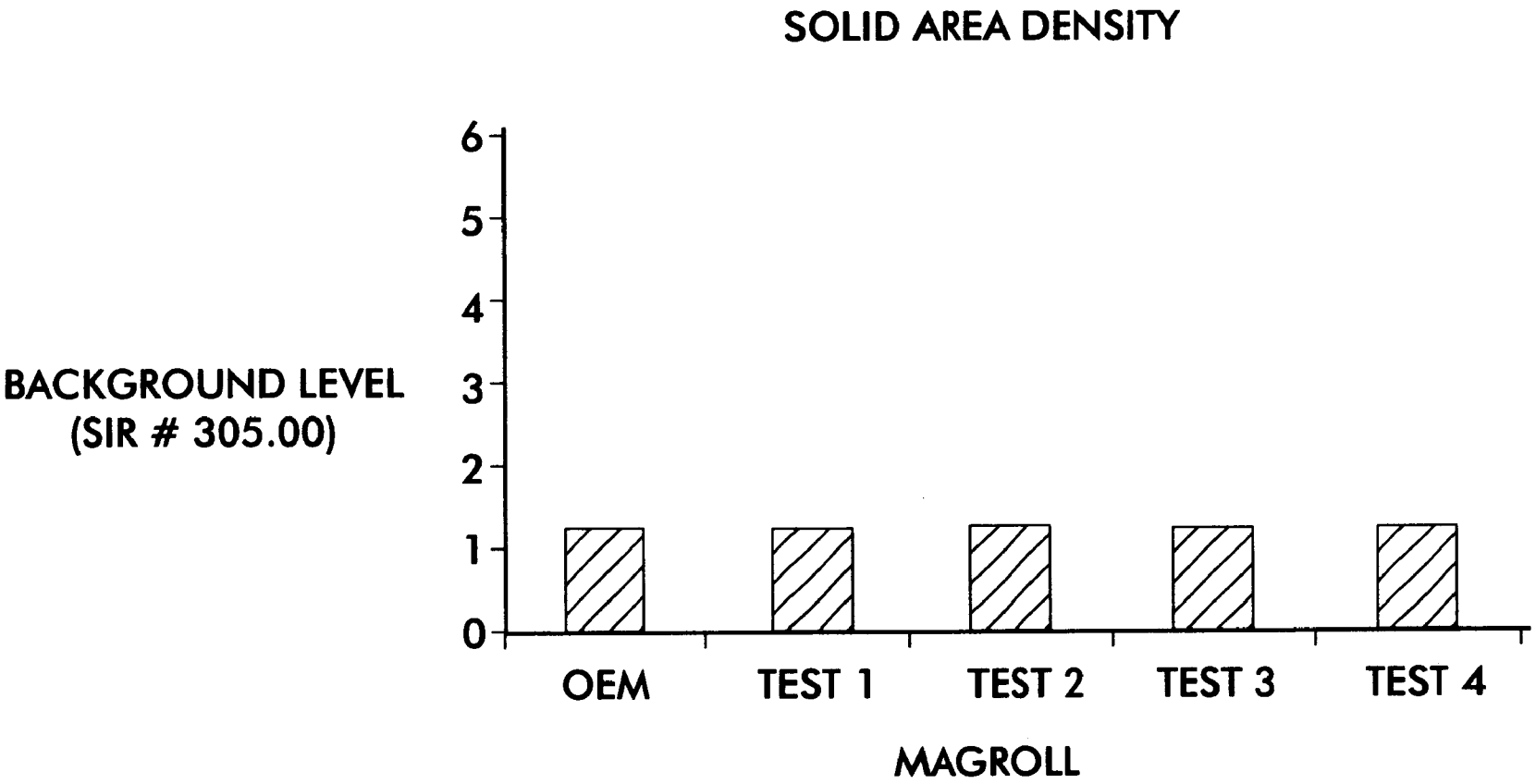
FIG. 5 is a bar graph depicting the comparative background level (measured according to the scale SIR #305.00) achieved by four embodiments of developer roll sleeves (Test I Magroll, Test 2 Magroll, Test 3 Magroll and Test 4 Magroll, each made in accordance with the present invention) and by a conventional developer roll sleeve (OEM Magroll). The bar graph compares the background level in accordance with Xerox Background Graininess SIR Scale #305.00 (82P502), incorporated herein by reference in its entirety. This particular scale (SIR #305.00) depicts patches of increasing levels of background shading indicating a reduction of print quality. By comparing the printed test document against the patches on the SIR #305.00 scale, the printed background can be "graded" to make an assessment of print quality.

A comparison of the "background level" achieved by the OEM and Test Magrolls was made in accordance with the detailed procedure outlined below. In particular, the detailed comparison procedure utilized the Background Graininess SIR #305.00 Scale. By comparing the printed document against the patches on the SIR #305.00 Scale, the "background level" was quantitated to assess print quality. The lower the "background level," the better the print quality. The bar graph of FIG. 5 provides the comparative "background level" data. It can be seen from FIG. 5 that all the Test 1–4 Magrolls performed as well as or better than the OEM Magroll in the background level comparison.

Example 5

Figure 6:
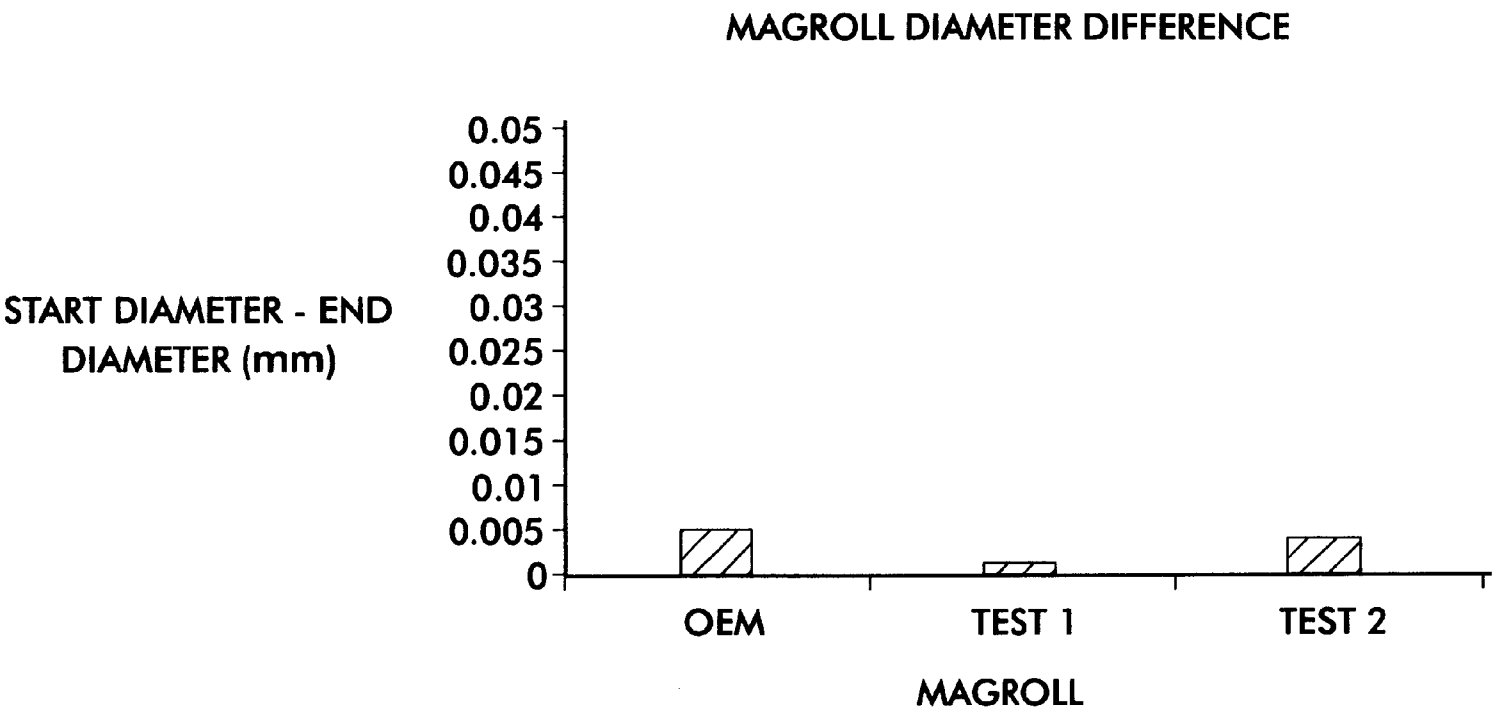
FIG. 6 is a bar graph depicting the comparative wear resistance of two embodiments of developer roll sleeves (Test 1 Magroll and Test 2 Magroll, each made in accordance with the present invention) and a conventional developer roll sleeve (OEM Magroll). The bar graph compares the change in diameter measured in mm of the various developer roll sleeve coatings tested after making 54,000 copies (one copy per printing cycle).
Figure 7:
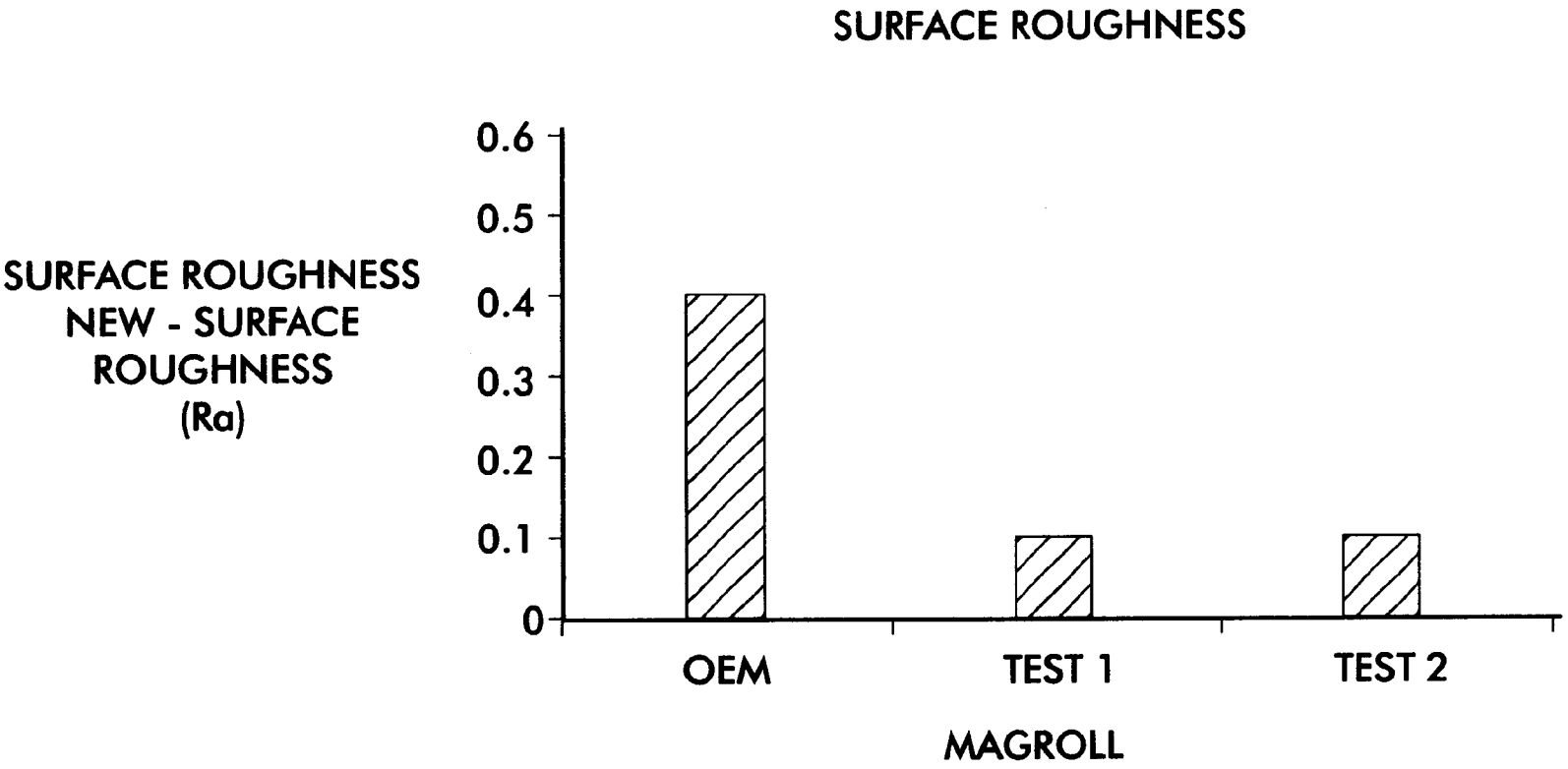
FIG. 7 is a bar graph depicting the comparative wear resistance of the OEM Magroll, the Test 1 Magroll and the Test 2 Magroll (referenced in FIG. 4) specifically comparing their surface roughness. The bar graph compares the change in the surface roughness measured in Ra ($\mu$m) units of the various developer roll sleeves tested after making 54,000 copies (one copy per printing cycle).

A comparison of the wear and tear on the various above noted Magrolls was made in accordance with the procedure outlined below. In particular, the detailed comparison procedure followed was to place the OEM and Test Magrolls into a Xerox 4213 developer module which was then used to make 54,000 test prints in a Xerox 4213 Laser Printer. After completion of the 54,000 prints, the thickness of the conductive composition coating and the surface roughness thereof were measured and compared to the same measurements (initial thickness and initial roughness) taken prior to installation of the OEM and Test Magrolls into the Xerox 4213 developer module. Surface roughness measurements were made using a Surfcom 575-3D System made by Tokyo Seimitsu. FIG. 6 indicates that the wear and tear on Test 1 Magroll was surprisingly and unexpectedly superior to that of the OEM Magroll and that the Test 2 Magroll also showed better wear resistance than the OEM Magroll. Further, FIG. 7 indicates that both the Test 1 Magroll and the Test 2 Magroll exhibited surprisingly and unexpectedly smoother (e.g., substantially defect free) surface roughness than did the OEM Magroll.

Example 6

Figure 8:
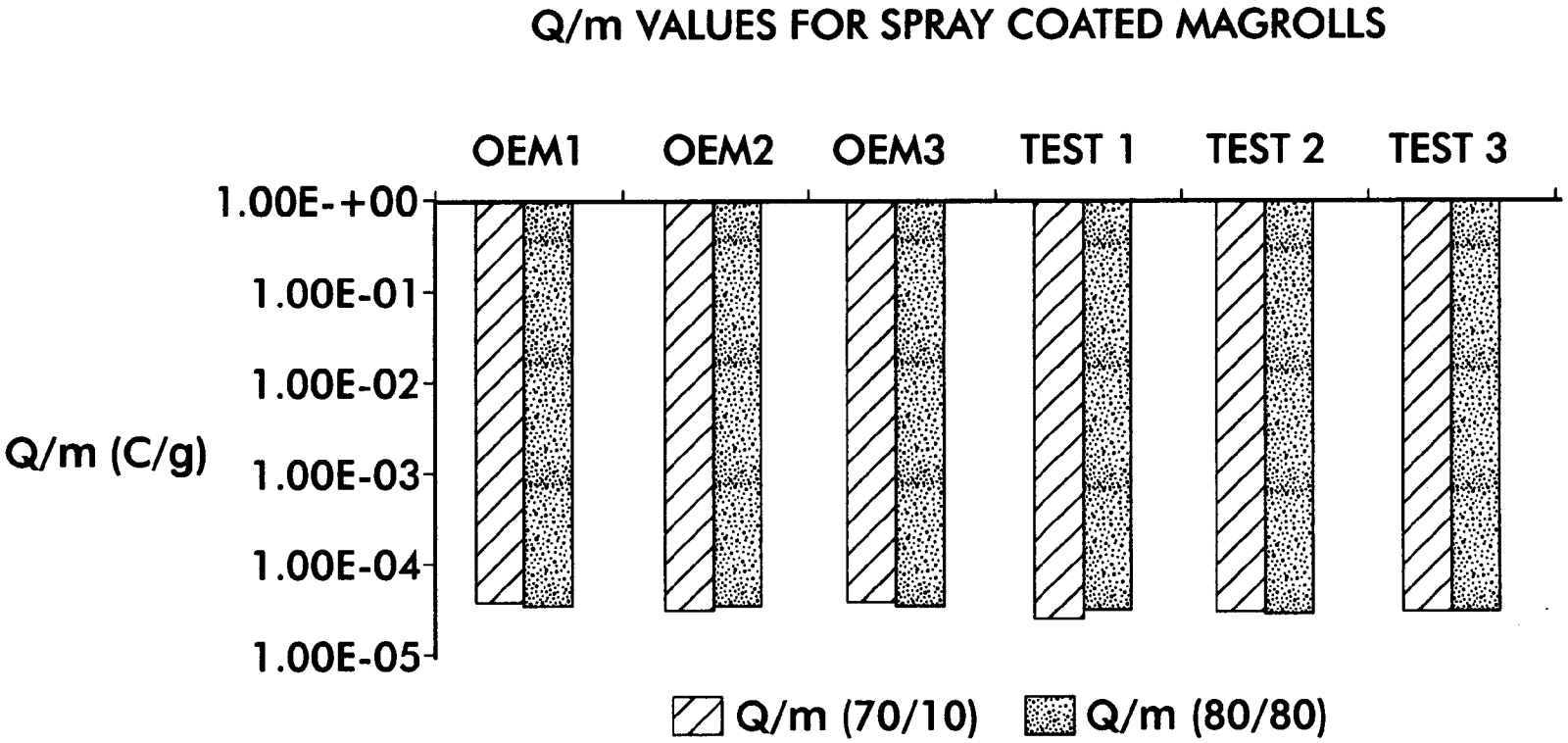
FIG. 8 is a bar graph depicting the comparative charge to mass ratios of three embodiments of developer roll sleeves (Test 1 Magroll, Test 2 Magroll and Test 3 Magroll each made in accordance with the present invention) and conventional developer roll sleeves (OEM1 Magroll, OEM2 Magroll, and OEM3 Magroll). The bar graph compares the charge to mass ratio (Q/m=70/10 and Q/m=80/80) in C/g units for the various spray coated Magrolls tested.
Figure 9:
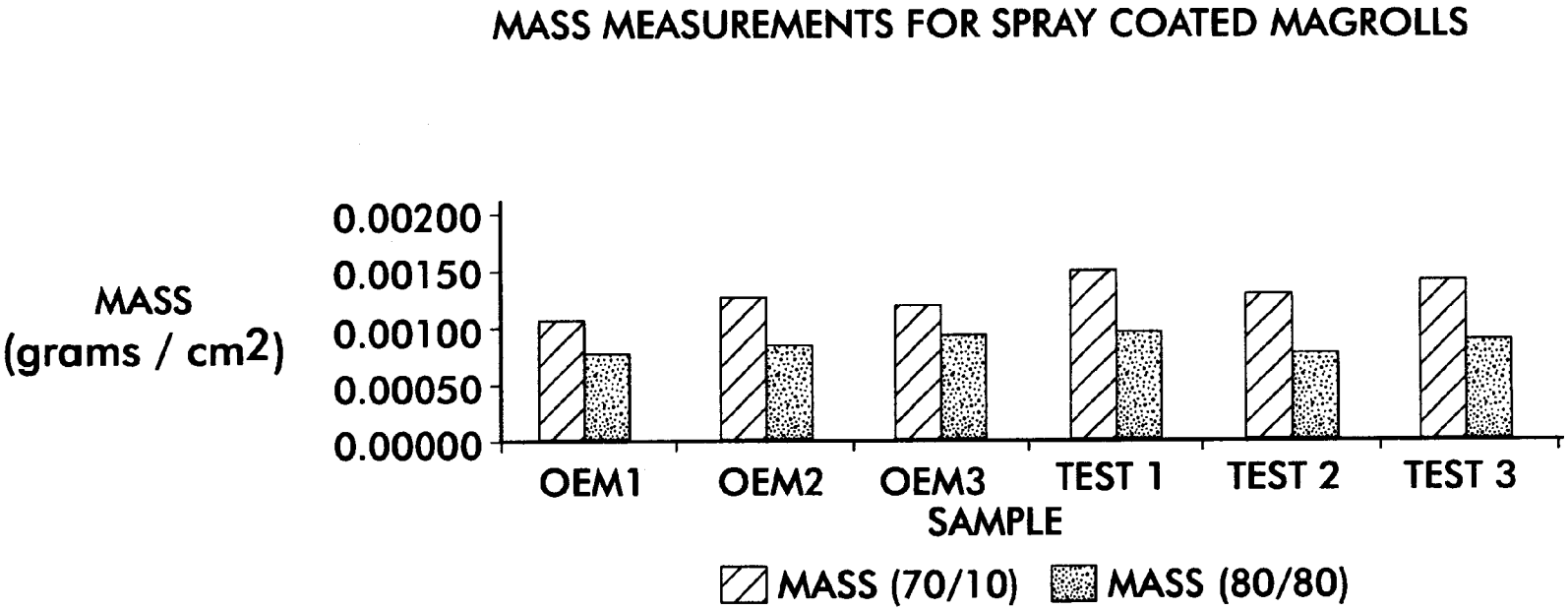
FIG. 9 is a bar graph depicting the comparative mass to surface area ratios of three embodiments of developer roll sleeves (Test 1 Magroll, Test 2 Magroll and Test 3 Magroll, each made in accordance with the present invention) and conventional developer roll sleeves (OEM1 Magroll, OEM2 Magroll, and OEM3 Magroll). The bar graph compares the charge to mass ratio (Q/m=70/10 and Q/m=80/80) in C/g units for the various spray coated Magrolls tested.

A comparison of the tribo measurements of the various above-noted Magrolls was made in accordance with the procedure outlined below. The tribo measurement is a function of the charge mass ratio of the toner. In particular, the following detailed comparison procedure was used. The OEM and Test Magrolls were placed into a Xerox 4213 developer module and 10–15 prints were made. After making these prints, the developer roll sleeve was removed from the Xerox 4213 developer module and the charge on the developer roll sleeve was measured using a Keithley 610C electrometer. The amount of toner on the developer roll sleeve also was measured by removing a defined amount of toner from the Magroll into a filter using a vacuum system. Then the net weight of the toner particles collected was determined (in milligrams per square centimeter of the developer roll sleeve surface). The tribo measurement is the charge measured divided by the weight of toner particles collected. FIGS. 8 and 9 indicate that the spray coated Test 1–3 Magrolls performed as well as or better than the OEM 1–3 Magrolls in this comparison.

While this invention has been described in conjunction with various embodiments, it is evident that many alternatives, modifications and variations will be apparent to those skilled in the art within the scope of the present invention. Accordingly, the claimed invention is intended to embrace all such alternatives, modifications, and variations as fall within the spirit and broad scope of the appended claims.

What is claimed is:

1. A developer roll sleeve comprising a core substrate roll coated with a conductive composition comprising thermosetting resin, a conductivity additive and a wear-resistance imparting additive, wherein said conductive composition is provided in an amount sufficient to obtain a thickness wear rate of less than about $4.7\times10^{-4}$ percent per printing cycle based on an initial thickness of said conductive composition of not more than 300 microns, and wherein said conductive composition is coated onto said core substrate roll by a method other than extrusion.

2. The developer roll sleeve of claim 1, wherein said thermosetting resin is a phenolic resin, and wherein said wear-resistance imparting additive is selected from the group consisting of a polytetrafluoroethylene resin, graphite, polyethylene having a molecular weight from about 3,000 to about 4,500, molybdenum, molybdenum disulfide, silicone and mixtures thereof.

3. The developer roll sleeve of claim 2, wherein said core substrate roll is made from a non-ferromagnetic material and said conductive composition has a conductivity from about 1 ohm-cm to about $10^{9}$ ohms-cm.

4. The developer roll sleeve of claim 3, wherein said conductivity additive is provided in an amount from about 1% to about 10% by weight based on a total weight of said conductive composition.

5. The developer roll sleeve of claim 4, wherein said conductivity additive is selected from the group consisting of carbon black, graphite and mixtures thereof.

6. The developer roll sleeve of claim 3, wherein said wear-resistance imparting additive is provided in an amount from about 0.5% to about 20% by weight based on a total weight of said conductive composition.

7. The developer roll sleeve of claim 6, wherein said conductive composition is spray coated, electrostatic coated, electroplate coated, roll coated or dip coated onto said core substrate roll.

8. The developer roll sleeve of claim 7, wherein said conductive composition has a thermosetted thickness from about 12 microns to about 300 microns.

9. The developer roll sleeve of claim 8, wherein said core substrate roll is made from a material selected from the group consisting of aluminum, plastic, non-ferromagnetic stainless steel and mixtures thereof.

10. A developer roll comprising a core substrate roll coated with a conductive composition comprising a thermosetting resin, a conductivity additive and a wear-resistance imparting additive, wherein said conductive composition is provided in an amount sufficient to obtain a thickness wear rate of less than about $4.7\times10^{-4}$ percent per printing cycle based on an initial thickness of said conductive composition of not more than 300 microns, and wherein said conductive composition is coated onto said core substrate roll by a method other than extrusion.

11. The developer roll of claim 10, wherein said thermosetting resin is a phenolic resin, wherein said wear-resistance imparting additive is selected from the group consisting of a polytetrafluoroethylene resin, graphite, polyethylene having a molecular weight from about 3,000 to about 4,500, molybdenum, molybdenum disulfide, silicone and mixtures thereof, and wherein said conductivity additive is carbon black.

* * * * *